US005195188A

United States Patent [19]

Bourdeau et al.

[11] Patent Number: 5,195,188

[45] Date of Patent: Mar. 23, 1993

[54] GOLFING GLOVE

[75] Inventors: Joël Bourdeau, Saint Jorioz; Jacques J. Autier, Cran Gevrier, both of France

[73] Assignee: Salomon S. A., Chavanod, France

[21] Appl. No.: 793,519

[22] Filed: Nov. 18, 1991

[30] Foreign Application Priority Data

Nov. 16, 1990 [FR] France ..... 90 14551

[51] Int. Cl.[5] ..... A41D 19/00

[52] U.S. Cl. ..... 2/161 A; 2/159

[58] Field of Search ..... 2/161 R, 161 A, 162, 2/159, 16, 20, 18, 19, 160, 169; 273/189 R, 188 R

[56] References Cited

U.S. PATENT DOCUMENTS

| | | | |
|---|---|---|---|
| 3,588,917 | 6/1971 | Antonious | 2/161 A |
| 3,600,715 | 8/1971 | Perrella | 2/162 |
| 3,952,333 | 4/1976 | Fujita | 2/161 A |
| 4,042,977 | 8/1977 | Antonious | 2/161 A |
| 4,502,688 | 3/1985 | Papp | 273/189 A |
| 4,691,388 | 9/1987 | Boone | 2/159 X |
| 4,701,963 | 10/1987 | Overton | 2/161 A |

*Primary Examiner*—Andrew M. Falik
*Assistant Examiner*—Sara M. Current
*Attorney, Agent, or Firm*—Pollock, Vande Sande & Priddy

[57] ABSTRACT

Sports glove, and more specifically a golfing glove, comprising tightening and tension means incorporating a tightening strap (3) which is slightly extensible or inextensible and is attached to a first end (31) on the dorsal metacarpal region (10), and which extends over a first length (32) in the direction of a first axis (X, X') and fits into an intermediate buckle (4) attached to the glove and positioned so as to be offset in proximity to the areas forming the edge (11) of the glove. The tightening strap extends over a length (33) which, beginning at the intermediate buckle (4), runs along a second axis (Y, Y') ending in a second end (34) which is movably attached, at least partially, to this metacarpal dorsal area (10) or to the wrist (12) area of the glove. The first axis (X, X') and the second axis (Y, Y') are offset by a positive angle ($\alpha$).

16 Claims, 3 Drawing Sheets

GOLFING GLOVE

FIELD OF THE INVENTION

The present invention concerns a sports glove, and more specifically a glove used for activities in which the hand plays an important role in holding objects with precision, particularly in golf.

BACKGROUND OF THE INVENTION

Gloves generally used in sports such as golf, racketball, and auto racing are traditionally made completely of leather and are cut so as to optimally mold to the contours and volumes of the hand, in order to provide proper strength and tightness. Their main functions are to absorb perspiration and prevent the hand from sliding on the object, thus improving prehension and tightening. Despite the know-how of the "pattern makers," the gloves are not adapted to all of the various existing morphologies. U.S. Pat. No. 3,588,917 introduced improvements by envisaging, in particular, a transverse tightening strap combined with elastic means on the dorsal portion of the glove in the metacarpal areas. This tightening arrangement certainly allows the broader adaptation of the glove to different types of hands, but cannot be applied uniformly over all of the parts of the glove, especially those which must be completely smooth, whatever the position of the hand and whether it is relaxed or closed over the object.

The glove in U.S. Pat. No. 4,691,388 comprises a diagonal opening extending from the base of the wrist to a point in proximity to the base of the little finger and which is tightened by a simple Velcro strap which thus generates diagonal tension. The major disadvantage of this system is that it has an opening which very appreciably complicates the fabrication of the glove, on the one hand, and which quickly becomes deformed after several uses, on the other. Finally, the use of a strap without reversing buckle causes unpleasant rotation when the glove is tightened, thereby requiring the continuous readjustment of the base of the glove.

SUMMARY OF THE INVENTION

The goal of the present invention is to propose a glove of simple design which remedies the aforementioned difficulties and makes it possible to preserve easy insertion of the hand without any special readjustment operation, adaptation to a larger number of different anatomical features, and finally, better distribution of the tightening force, thus creating a close adjustment of the parts of the glove to the functional areas of the hand and improving, in consequence, the practice of the activity and the performance achieved.

To this end, the sports glove according to the present invention, comprising tightening and tension means incorporating a tightening strap which is slightly extensible or inextensible and is attached to its first end in the dorsal metacarpal area of the glove and which extends over a first length along a first axis (X, X') and fits into an intermediate buckle attached to the glove and positioned so as to be offset in proximity to the region forming the edge of the glove, this tightening strap extending over a second length beginning at the intermediate buckle along a second axis Y, Y' and ending in its second end and being movably attached at least partially to this dorsal or wrist area, is characterized by the fact that the first axis X, X' and the second axis Y, Y' are offset by a positive angle $\alpha$.

BRIEF DESCRIPTION OF THE DRAWINGS

The invention will be described in more detailed fashion, and other advantages and features will emerge with reference to the attached drawings provided as examples and in which.

DETAILED DESCRIPTION

A glove is a complex, three-dimensional object whose shapes derive from a geometry governed by no special rule of symmetry. At the very most, common anatomical regions can be delimited, thus making it possible to identify "geographically" the features that will emerge specifically from the invention.

Figure 1:
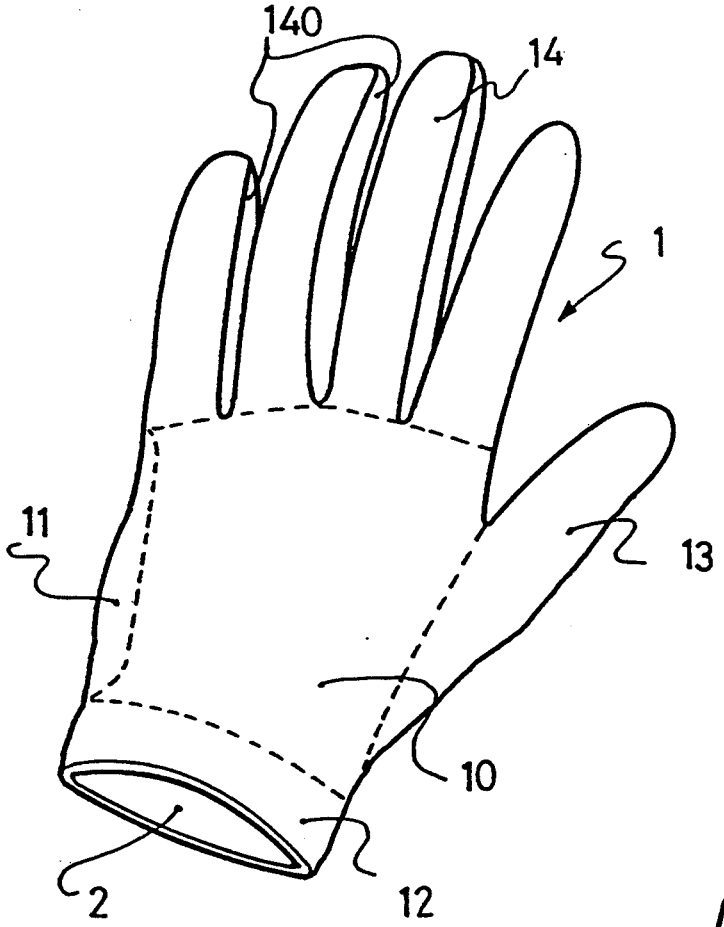
FIG. 1 is a simplified dorsal view of a glove on which the principal anatomical regions are diagrammatically represented.
Figure 2:
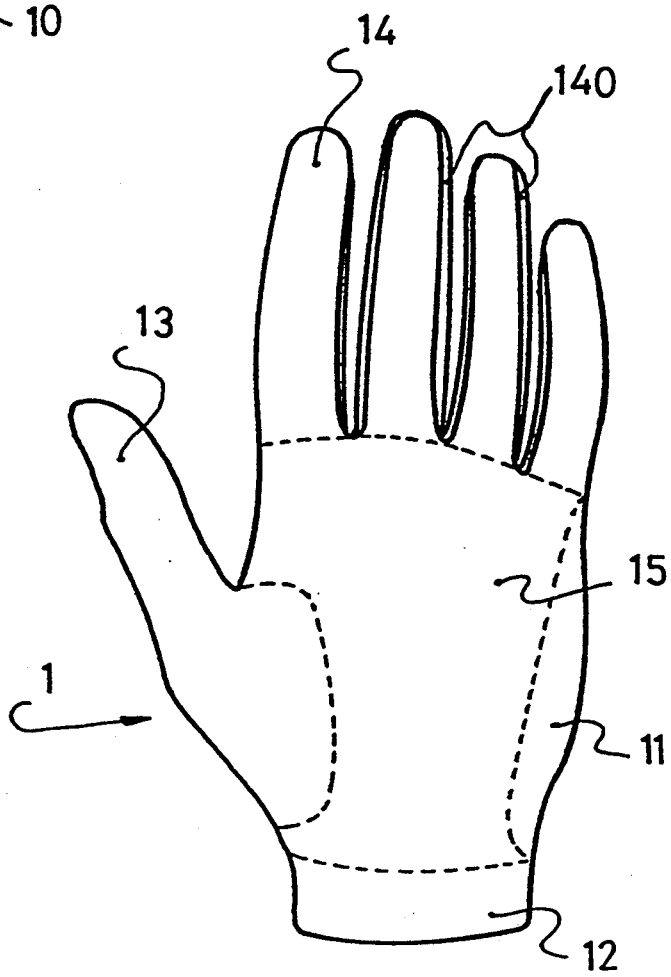
FIG. 2 is a palmar view of the glove in FIG. 1.

Accordingly, as shown in FIG. 1, the glove 1 can be "cut out" in several areas, each of which corresponds to an anatomical region of the hand. The principal region is called the dorsal region of the metacarpus, or metacarpal region 10. The edge area 11, which extends along the side of the glove up to the boundary of the palmar region 15 (illustrated in FIG. 2) can be isolated to the outside of the dorsal region. The glove extends more or less beyond the hand and into the substantially ring-shaped area of the wrist 12, called the carpal region.

Finally, the fingers can be divided into two separate regions: the thumb area 13 comprising the thenar eminence and the phalangeal region 14, each of which extends from the base of the fingers to their tips. The parts forming the thickness of the four phalanges in the phalangeal region 14 of the glove, which are normally six added pieces, are called forks 140. In this case, what is termed the inner side of a finger is the lateral side of the finger facing the lateral side of the adjoining one.

Figure 3:
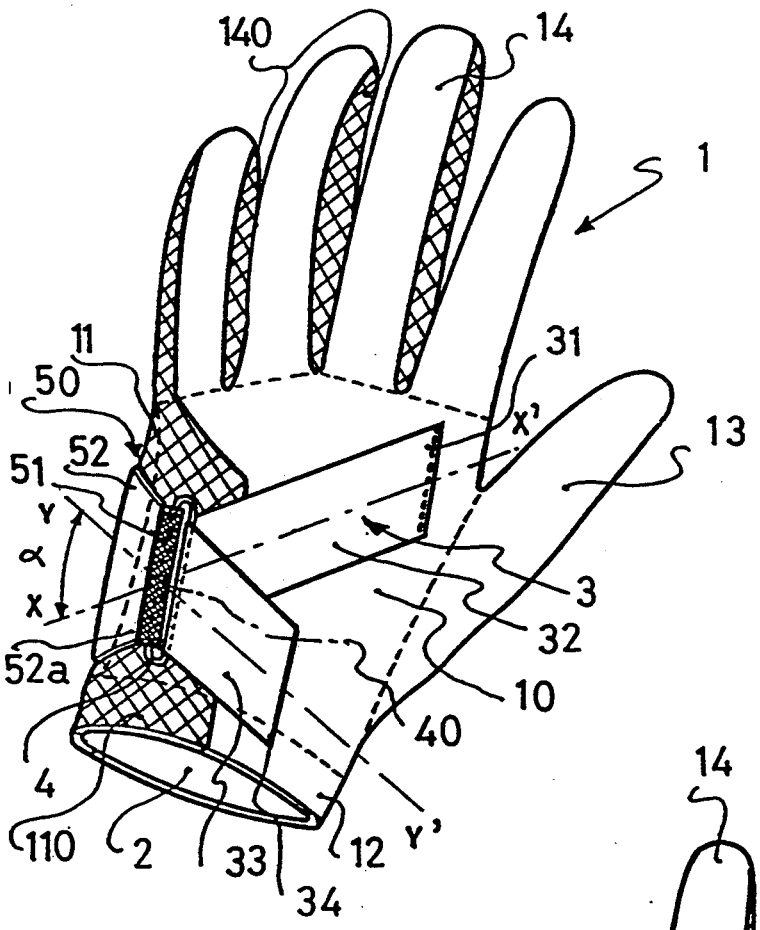
FIG. 3 is a dorsal view of a glove according to the invention.

The sports glove according to the present invention comprises various tightening and tension means, the principal means being a tightening strap 3, e.g., as illustrated in FIG. 3. To permit the hand to be inserted, the glove must have a sufficient opening 2 which at least matches the area of the largest section of the hand. When the hand is inserted, the opening section may be enlarged by means of the elasticity of the extensible pieces forming the body of the glove 1, but proper tightening is achieved only through the use of a dorsal strap 3. This strap, which is only slightly extensible or inextensible, is attached to its first end 31 on the metacarpal region 10 and extends over a first length 32 and along a first axis X, X'. It fits into and intermediate buckle 4 which forms one piece with the glove and is offset in proximity to the edge region 11. The strap 3 extends over a second length 33, beginning at the intermediate buckle 4 along axis Y, Y' and terminates in its end 34, which is movably attached, at least in part, to the metacarpal region 10 or to the wrist area 12. It may advantageously be specified that the means of attachment of the second end 34 be of the hook and loop fastener variety such as the type known by the trademark VELCRO, for example. The first axis X, X' and the second axis Y, Y' are angularly offset by a positive angle $\alpha$ in relation to the central point 40 of the intermediate buckle 4. This offset arrangement thus allows the strap to exert tensive forces in three directions that can be diagrammatically represented by a "Y" and which correspond to the preferred tightening areas of a glove.

Figure 5:
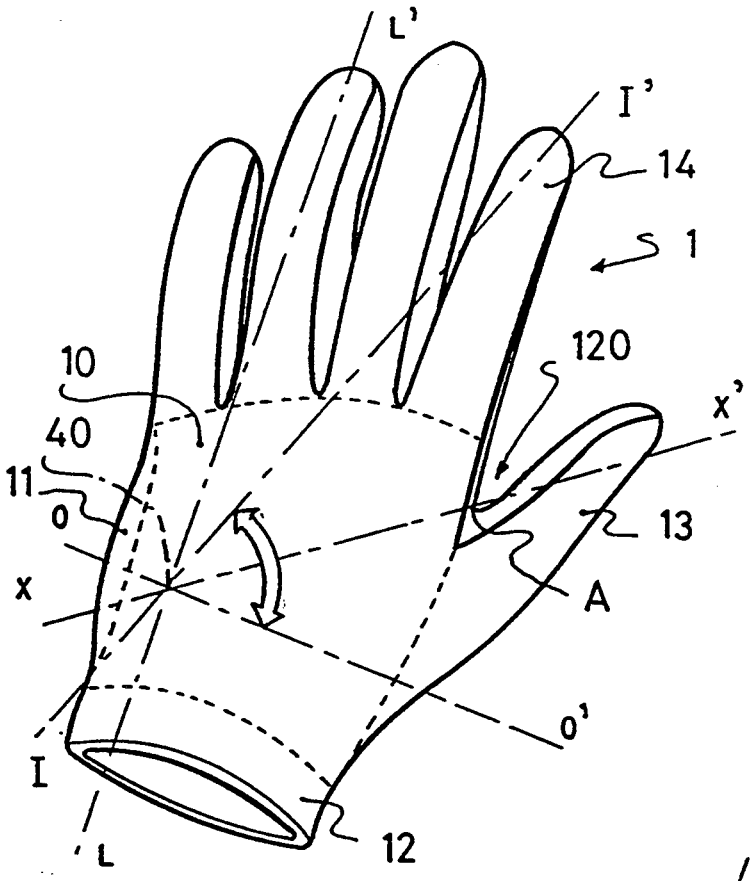
FIGS. 5 and 6 are simplified, diagrammatic dorsal views of the glove according to the invention which determine, more specifically, the areas in which the different axes X, X' and Y, Y' can be inscribed.

As illustrated in FIG. 5, the axis X, X' corresponding to a first direction can, beginning at the central point 40 of the tensive forces, be positioned in an area bounded by the transverse axis 0, 0', which is perpendicular to the longitudinal axis L L' approximately corresponding to the direction of the phalanges, and axis I, I', which passes through the tip of the index finger in the phalangeal region 14. This region corresponds to the different positionings of axis X, X'; special advantage is gained when the tensive forces are exerted between the thumb and the index finger. Accordingly, it is preferable that axis X, X' pass substantially through a point A located in the recess 120 between the thumb and index finger.

Figure 6:
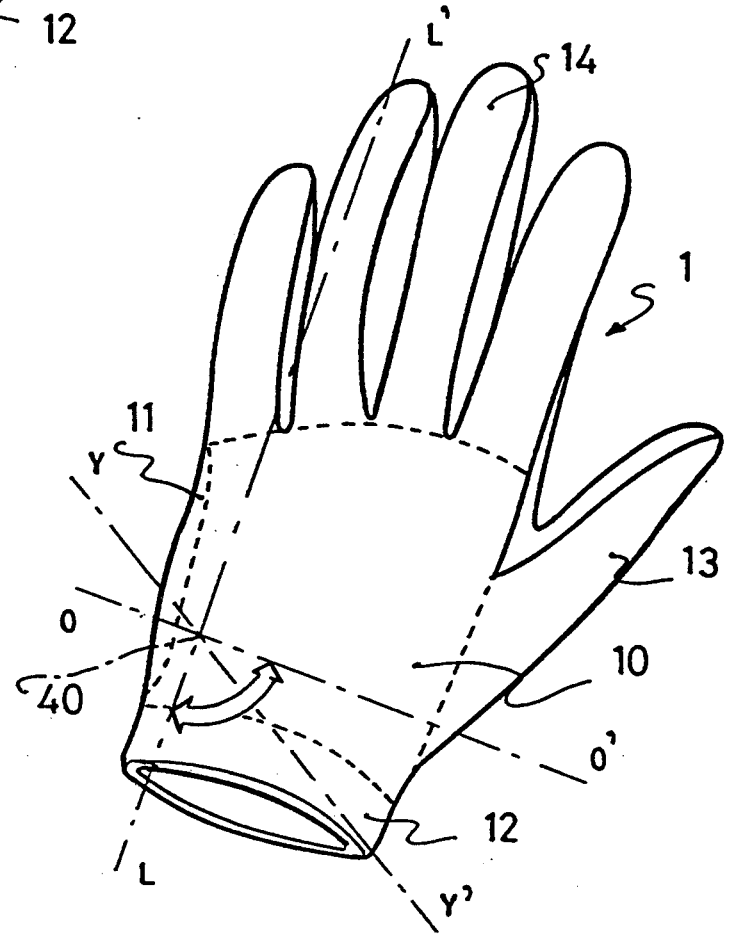

As shown in FIG. 6, axis Y, Y' corresponding to the second direction of the tensive forces may be positioned beginning at the central point 40 of the intermediate buckle 4 and extending in a region bounded by the transverse axis O, O' and the longitudinal axis L, L'. Preferably, axis Y, Y' extends substantially in a region located between the base of the thumb region 13 and the area of the wrist 12, to ensure that the tightening force in this area be effectively applied.

The third direction of the tensive forces, the resultant of the first two directions, is preferably positioned substantially along the transverse axis O, )', the point of application of these forces being, of course, located at the central point 40 of the buckle. Application of a tensive force in this direction generates effective transverse tightening.

As shown in FIG. 3, the intermediate buckle forms one piece with a connection strap 50, which is itself solidly attached to the edge region 11 and is preferably formed, at least in part, from a portion 51 of a deformable elastic strap. The function of this elastic portion is to ensure constant tightening force, whatever the variations in the volume of the hand, for example when the fingers move. The other portion 52 of the strap is composed of a strong, slightly extensible material, preferably leather. This portion 52 is advantageously shaped substantially like a trapezoid, whose small base **52*a* extends toward the buckle 4 and whose large base 52*b* forms one piece with the edge (11**). This special shape improves the distribution of the transverse tensive forces.

The tightening strap 3 is itself advantageously made of leather. It can, of course, be made of a textile or other material; in addition, reinforcement pieces may be provided.

The glove according to the present invention possesses other tightening means which cooperate with the tightening strap 4 so as to impart uniform tension to the various parts of the glove. To this end, it is specified that certain parts which are particularly subject to stress or undergo greater deformation are formed from added pieces made of a highly extensible and elastic material. Elasthane-based textiles are preferably used.

Accordingly, the forks 140 located in the phalangeal region 14 may advantageously be formed from added pieces possessing these characteristics and whose length, when extended, corresponds to the length of the phalanges in their normal opened position. The use of these pieces allows broader adaptation of the glove to various kinds of fingers having quite different sections. Similarly, the stresses generated by the frequent movements of the phalanges are thus largely absorbed.

Of course, a reverse situation may also be specified, in which the forks 140 are made of a material possessing only slight extensibility, e.g., leather, and in which the other areas covering the phalanges are made of an extensible, elastic material.

The invention also calls for the arrangement of an extensible added piece 110 which at least partially covers the edge region 11. This region corresponds, in fact, to the most pronounced deformation, especially deformation of volume, when the fingers are folded. Advantageously, this piece 110 extends continuously beyond the edge region 11 toward the dorsal metacarpal region 10 and up to a boundary on this side of the area of attachment of the first end 31 of the tightening strap 3. This extension advantageously allows absorption, over a larger surface, of the folds resulting from tightening of the strap 3.

Figure 4:
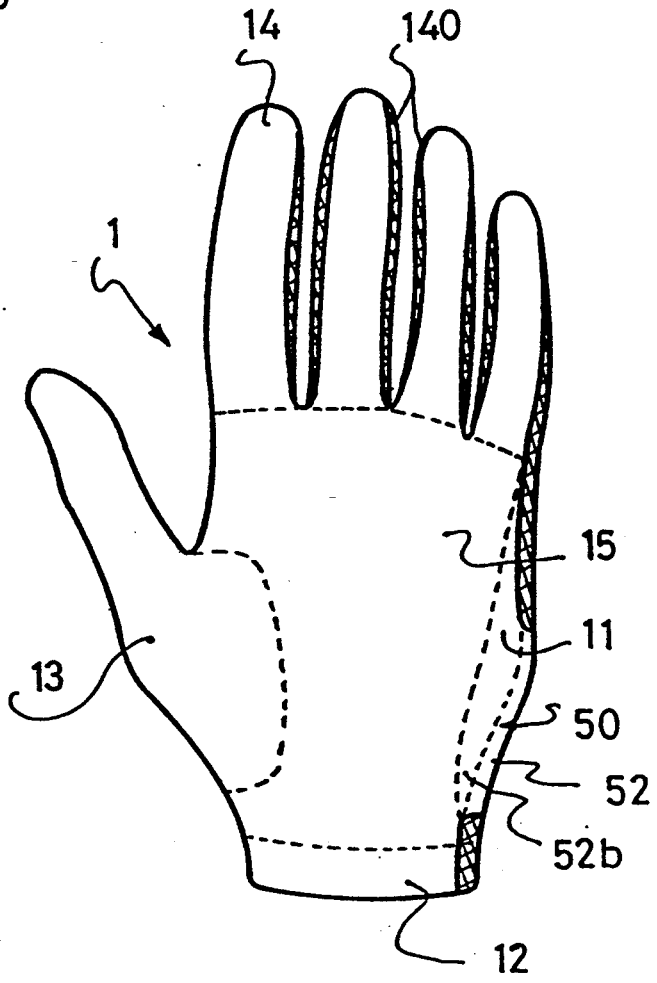
FIG. 4 is a palmar view of the glove according to the invention in FIG. 3.

The added piece 110 may potentially be continuously extended beyond the edge area 10 over the outer portion of the little finger and over at least a substantial portion of its length, as shown in FIGS. 3 and 4.

Of course, the foregoing description of the invention is provided only as a non-limiting example and encompasses all generalized application and embodiments contained in the following claims.

What is claimed is:

1. Sports glove (1) comprising tightening and tension means comprising a slightly extensible or inextensible tightening strap (3) attached at a first end (31) on the dorsal metacarpal region (10) of said glove (1) and extending over a first length (32) buckle (4) forming one piece with said glove and arranged in an offset position in proximity to the region forming the edge area (11) of the glove, said tightening strap (3) extending from said intermediate buckle (4) over a second length (33) along a second axis (Y, Y') and ending in a second end (34) movably attached, at least in part, to said dorsal metacarpal region (10) or to the wrist area (12) of said glove, wherein said first axis (X, X') and said second axis (Y, Y') are angularly offset by a positive angle ($\alpha$).

2. Sports glove according to claim 1, wherein said first axis (X, X') is positioned, beginning at the center point (40) of said intermediate buckle (4), in an area bounded by an axis (O, O') transverse to said glove and an axis (I, I') which passes through the tip of the index finger.

3. Sports glove according to claim 2, wherein said first axis (X, X') extends approximately through a point (A) located in the recess (120) between the thumb and the index finger.

4. Sports glove according to claim 2, wherein the resultant of the tensive forces exerted along said first and second axes (X, X' and Y, Y') extends along said transverse axis (O, O').

5. Sports glove according to claim 1, wherein said second axis (Y, Y') is positioned, beginning at the central point (40) of said intermediate buckle (4) in an area bounded by an axis transverse to said glove (O, O') and a longitudinal axis (L,L') which extends substantially parallel to the fingers.

6. Sports glove according to claim 5, wherein said second axis (Y, Y') extends approximately through an area between the base of the thumb region (13) and the wrist area (12).

7. Sports glove according to claim 1, wherein said intermediate buckle (4) forms one piece with a connection strap (50), which is itself solidly attached to said edge area (11).

8. Sports glove according to claim 7, wherein said connection strap (50) is at least partially composed of a portion (51) of a deformable elastic strap.

9. Sports glove according to claim 8, wherein said connection strap (50) is composed of a succession of at least two portions of a strap (51, 52), of which at least one (52) is made of a material possessing only very slight extensibility.

10. Sports glove according to claim 9, wherein the very slightly extensible portion (52) of said buckle is shaped substantially like a trapezoid.

11. Sports glove according to claim 1, comprising added pieces made of a highly extensible, elastic material and placed in areas of the most pronounced deformation.

12. Sports glove according to claim 11, wherein said extensible added pieces are made of an elasthane-based textile.

13. Sports glove according to claim 11, wherein said added pieces form forks (140) positioned in the phalangeal region (14).

14. Sports glove according to claim 13, wherein said forks have, when extended, lengths corresponding to the lengths of the phalanges in the opened position.

15. Sports glove according to claim 11, wherein at least one (110) of said added pieces is placed at least partially in said edge area (11).

16. Sports glove according to claim 15, wherein at least one of said added pieces extends continuously beyond said edge area (11) toward said dorsal region (10) up to a boundary beyond the area of attachment of said first end (31) of said tightening strap (3).

* * * * *